United States Patent [19]

Burnham

[11] 4,178,978

[45] Dec. 18, 1979

[54] MANUAL OPERATOR FOR COILING DOOR

[75] Inventor: Peter B. Burnham, Columbus, Ohio

[73] Assignee: Harsco Corporation, Camp Hill, Pa.

[21] Appl. No.: 919,293

[22] Filed: Jun. 26, 1978

[51] Int. Cl.[2] ..... A47G 5/02; E06B 9/08

[52] U.S. Cl. ..... 160/321; 160/133

[58] Field of Search ..... 160/133, 307, 308, 318, 160/319, 320, 321, 322

[56] References Cited

U.S. PATENT DOCUMENTS

| | | | |
|---|---|---|---|
| 422,292 | 2/1890 | Chase | 160/320 |
| 1,453,939 | 5/1923 | Koenig | 160/320 |
| 1,469,842 | 10/1923 | Livingston | 160/320 |
| 3,424,224 | 1/1969 | Lowe | 160/308 |

FOREIGN PATENT DOCUMENTS

| | | | |
|---|---|---|---|
| 1267871 | 6/1961 | France | 160/321 |
| 89536 | 4/1937 | Sweden | 160/321 |

*Primary Examiner*—Peter M. Caun

*Attorney, Agent, or Firm*—Cameron, Kerkam, Sutton, Stowell & Stowell

[57] ABSTRACT

A manual operator for a coiling door has a reel mounted for free rotation on a shaft supporting drums to which the coiling door is secured. An endless flexible non-extensible element is mounted on the reel with a sufficient number of turns thereon for complete opening or closing of the door and the reel is secured to the adjacent one of the door supporting drums. The resilient non-extensible element is manually drawn to open or close the door and may be provided with hand holds to facilitate grasping thereof. A guide for the flexible non-extensible element may be secured adjacent the reel to guide the flexible non-extensible element onto and off of the reel.

1 Claim, 3 Drawing Figures

MANUAL OPERATOR FOR COILING DOOR

REFERENCE TO RELATED APPLICATION

Pending U.S. application Ser. No. 895,022, filed Apr. 10, 1978 for Coiling Door by Peter B. Burnham et al discloses and claims a coiling door with which the present manual operator might be used in place of the operator there described.

BACKGROUND OF THE INVENTION

Coiling doors have come into extensive use in warehouses, garages, and buildings for openings requiring a closure which is easily actuated to an out-of-the-way position to completely uncover the opening and yet, when closed, provide a strong and secure closure. U.S. application Ser. No. 895,022 refers to coiling doors of the type now commercially available and such commercially available coiling doors are usually mechanically and/or electrically actuated for opening and closing.

Early U.S. Pat. Nos. 98,384 and 201,109 presently found in Class 160, Subclass 320 in the Classification of U.S. Patents disclosed drum and rope configurations for rotating a drum for raising and lowering window curtains with a guide for the rope being shown in U.S. Pat. No. 201,109. In both of these early patents the reel is secured to a shaft for rotating the shaft and the curtain material is secured to the shaft.

BRIEF DESCRIPTION OF THE INVENTION

A manual operator for a coiling door comprises brackets spaced apart at the top of the door opening and secured thereto with a fixed shaft extending between the brackets and fixed to the brackets. A plurality of drums are mounted for free rotation on the shaft and the upper edge of the coiling door is secured to these drums. Counter balance springs may be mounted on the shaft and secured to the drums, as is well known in the art, to assist in the raising and lowering of the coiling door. A reel is freely mounted on the shaft and is secured to an adjacent one of the drums on one side of the coiling door adjacent to the nearest support bracket. An endless flexible non-extensible member such as a rope is mounted on the reel with the required number of turns for rotating the reel and thus the drums to move the coiling door from fully open to fully closed position and from fully closed to fully open position. A guide for the leads of the endless flexible non-extensible member or rope may be mounted on the bracket adjacent the reel and griping elements for assisting in grasping the rope may be mounted on the rope.

BRIEF DESCRIPTION OF THE ACCOMPANYING DRAWINGS

In the accompanying drawings, in which like reference characters indicate like parts and in which a preferred embodiment of the present invention is shown, FIG. 1 is an elevational view of a coiling door and a manual operator therefore in accordance with the present invention;

FIG. 2 is a view partly in section as seen from the left in FIG. 1 of the reel receiving the endless flexible non-extensible element or rope; and FIG. 3 is a partial sectional view on the line 3—3 of FIG. 2 showing a portion of the reel, adjacent drum, and coiling door together with turns of the flexible non-extensible element or rope on the reel.

DESCRIPTION OF THE PREFERRED EMBODIMENT

Figure 1:
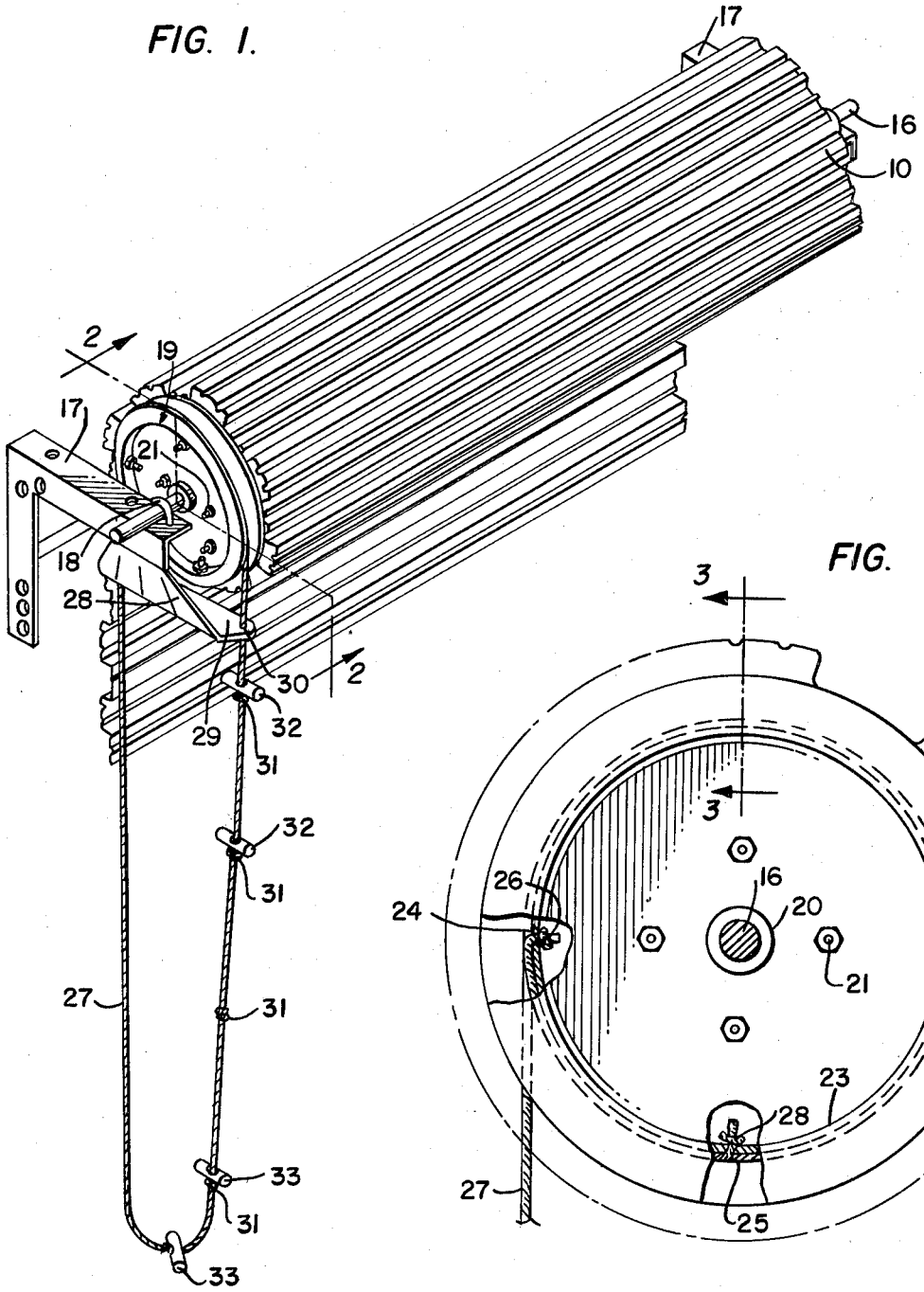

As in known in the art, a coiling door generally indicated at 10 has a shaft 16 which is secured against rotation on spaced brackets 17 by clamps 18, brackets 17 being secured to the building wall adjacent the upper end of the opening to be closed. A plurality of drums 15 are mounted for free rotation on shaft 16 between brackets 17 and an edge of the coiling door 10 is secured to drums 15 in known manner as by metal screws or welding or the like. A reel 19 having a bearing boss 20 is mounted for free rotation on the shaft 16 and is secured to the adjacent one of drums 15 by suitable means such as bolts and nuts 21 with reel 19 being located proximate to the adjacent one of brackets 17. Reel 19 has flange 22 and rim 23 and rim 23 is provided with apertures 24 and 25. One end 26 of flexible non-extensible element or rope 27 passes through aperture 24 and is secured as by a knot formed in the end thereof and the other end of rope 27 after a plurality of turns around rim 23, three turns being shown in FIG. 3, passes through aperture 25 and is secured in position as by knot 28'.

The coiling door shown in FIG. 1 is shown in closed position and the number of turns of rope 27 on rim 23 will depend upon the height of the door to be raised. For example, the number of turns of rope required will equal the number of turns of reel 19 required to open or close the door, usually from two to four turns. The reel should have a diameter such that two turns of rope will be sufficient for a door 6½ feet high with 3½ turns for a door 12½ feet high. Other door heights will require a proportionate number of turns.

A metal stamping 28 is suitably secured to bracket 17, as by welding, with an inturned flange 29 located beneath reel 19 and apertures 30 are provided therein to receive rope 27 to guide rope 27 onto and off of reel 19.

Four spaced knots 31 are provided on one run of rope 27 as seen in FIG. 1 with open handles 32 slidably mounted on rope 27 above the upper pair of knots and with close handles 33 slidably mounted on rope 27 above the lower two knots 31.

Figure 2:
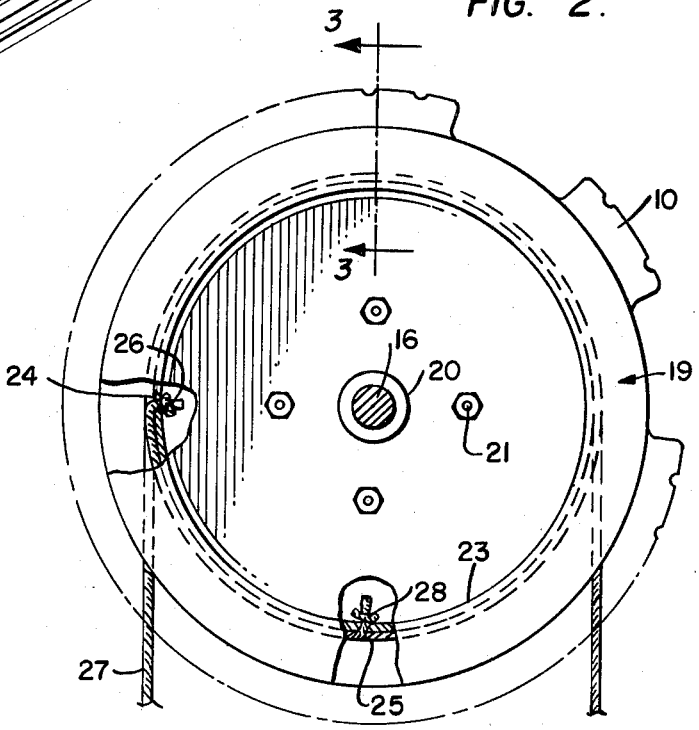
Figure 3:
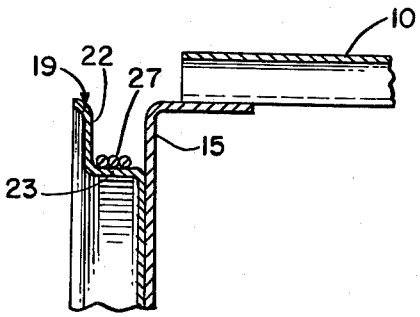

With the coiled door in the closed position as shown in FIGS. 1, 2 and 3, to open the door any locking device which may be used with the door in known manner is first released and then the upper two open handles 32 are manually grasped and the right hand run of rope 27 pulled manually downward to rotate reel 19 in a clockwise direction as seen in FIG. 2. Clockwise rotation of reel 19 will cause clockwise rotation of drums 15 and the coiling of door 10 thereon until the door is in open position, three turns of rope 27 on reel 19 usually being sufficient for this purpose. During the opening of the door the left hand run of rope 27 will be wound upon reel 19 as the right hand run is pulled downwardly so that when the door is in open position there will be approximately three turns of the left hand run of rope 27 on the reel 19.

With the door in open position the close handles 33 are resting on knots 31 on the left hand run of rope 27 for manual grasping when the door is to be closed. When the door is to be closed close handles 33 are manually grasped and the left hand run of rope 27 is pulled downwardly which rotates reel 19 in a counter clockwise direction as seen in FIG. 2 resulting in the uncoiling of the door from drums 15 and downward movement of the door 10 to closed position.

What I claim is:

1. A manual operator for a coiling door including spaced brackets secured adjacent the top of the door opening, a shaft fixed to said brackets; drums rotatably mounted on said shaft and a coiling door having an edge secured to said drums comprising a reel rotatably mounted on said shaft adjacent one of said brackets; means for securing said reel to the adjacent one of said drums; an endless flexible non-extensible element, opposite ends for said element secured to said reel, a plurality of turns of said element on said reel, guide means directly secured to said bracket adjacent said reel and underlying said reel for guiding said element onto and off of said reel and a plurality of spaced stops on said element and a plurality of manually grasped grips slidably mounted on said element for engagement with said stops whereby when said element is manually pulled in one direction rotation of said reel opens said door and when said element is manually pulled in the other direction opposite rotation of said reel will close said door.

* * * * *